US005403017A

United States Patent [19]

Doss, III et al.

[11] Patent Number: 5,403,017

[45] Date of Patent: Apr. 4, 1995

[54] TARGET LIFTER WITH IMPACT SENSING

[75] Inventors: Samuel C. Doss, III, Scottsboro; Paul F. Harper, New Market, both of Ala.

[73] Assignee: Unisys Corporation, Blue Bell, Pa.

[21] Appl. No.: 122,832

[22] Filed: Sep. 16, 1993

[51] Int. Cl.[6] ..... F41J 5/06

[52] U.S. Cl. ..... 273/372; 273/386,391; 273/406

[58] Field of Search ..... 273/372, 378, 386, 390, 273/391, 392, 406, 407, 371; 434/11, 16

[56] References Cited

U.S. PATENT DOCUMENTS

| | | |
|---|---|---|
| 222,742 | 12/1879 | Schofield . |
| 225,215 | 3/1882 | Tuttle . |
| 471,430 | 3/1892 | Porter . |
| 473,332 | 4/1892 | Nelson . |
| 824,307 | 6/1906 | Mount . |
| 858,990 | 7/1907 | Kemper . |
| 1,195,185 | 8/1916 | Corbett . |
| 1,413,032 | 4/1922 | Kennedy, Jr. . |
| 1,531,420 | 3/1925 | Shears . |
| 1,640,954 | 8/1927 | Mach . |
| 1,668,675 | 5/1928 | Fey . |
| 1,727,272 | 9/1929 | Caswell . |
| 1,734,546 | 11/1929 | Veling . |
| 1,743,337 | 1/1930 | Fey . |
| 1,761,039 | 6/1930 | Hazeltine . |
| 1,831,289 | 11/1931 | Dally . |
| 1,865,988 | 7/1932 | Wiedeck . |
| 1,889,202 | 11/1932 | Karnes . |
| 1,948,104 | 2/1934 | Firestone et al. . |
| 2,085,933 | 7/1937 | Vaughan . |
| 2,116,522 | 5/1938 | Kunze . |
| 2,152,026 | 3/1939 | Bunnerlight . |
| 2,269,760 | 1/1942 | Eldredge . |
| 2,275,675 | 3/1942 | Draper et al. . |
| 2,310,085 | 2/1943 | Hooker et al. . |
| 2,427,010 | 9/1947 | Lohr . |
| 2,435,031 | 1/1948 | Burns et al. . |
| 2,445,318 | 7/1948 | Eldredge et al. . |
| 2,457,832 | 1/1949 | Poorman . |
| 2,534,276 | 12/1950 | Lancor, Jr. . |
| 2,586,958 | 2/1952 | Keller . |
| 2,598,709 | 6/1952 | Morris . |
| 2,605,104 | 7/1952 | Hamrick . |
| 2,808,522 | 10/1957 | Dranetz . |
| 2,814,742 | 11/1957 | Tognola . |
| 2,826,706 | 3/1958 | Sackett . |
| 2,846,563 | 8/1958 | Cronin . |
| 2,855,916 | 10/1958 | Foster . |
| 2,899,204 | 8/1959 | Ratay . |
| 2,926,015 | 2/1960 | Edrich . |
| 2,967,957 | 1/1961 | Massa . |
| 2,978,670 | 4/1961 | Peek, Jr. . |
| 2,978,700 | 4/1961 | Stevens et al. . |
| 2,980,898 | 4/1961 | Mason et al. . |
| 3,034,788 | 5/1962 | Cauble . |
| 3,042,744 | 7/1962 | Shoor . |
| 3,044,312 | 7/1962 | Hall et al. . |
| 3,060,748 | 10/1962 | Schwartz . |
| 3,088,098 | 4/1963 | Moore . |
| 3,093,710 | 6/1963 | Ten Eyck . |
| 3,097,848 | 7/1963 | Massa . |
| 3,113,223 | 12/1963 | Smith et al. . |
| 3,120,622 | 2/1964 | Dranetz et al. . |
| 3,128,096 | 4/1964 | Hammond et al. . |
| 3,148,290 | 9/1964 | Dranetz et al. . |
| 3,170,076 | 2/1965 | Wing . |
| 3,233,904 | 2/1966 | Gillam et al. . |

(List continued on next page.)

OTHER PUBLICATIONS

*Ramsey Winch Company Owners Manual, Front Mount ELectric Winches, Model REP 5000, Model REP 6000, Model REP 8000, Model REP 8000X* (Ramsey Winch Company, Tulsa, Oklahoma, Oct. 1991) pp. 1, 8 and 12.

*Primary Examiner*—William H. Grieb

*Attorney, Agent, or Firm*—Stanton D. Weinstein; Mark T. Starr

[57] ABSTRACT

This is a commercial capable heavy lifter capable of rotating or levering large objects up and down by remote control. When used to so raise and lower targets on a firing range, the target can be dropped automatically when the target receives one or more hits.

22 Claims, 12 Drawing Sheets

U.S. PATENT DOCUMENTS 3,238,642 3/1966 Ohlund .
3,311,761 3/1967 Schloss .
3,323,800 6/1967 Knight .
3,348,843 10/1967 Stanley .
3,392,980 7/1968 Ortega .
3,393,557 7/1968 Brown et al. .
3,453,457 7/1969 Hayer et al. .
3,487,640 1/1970 Wostl et al. .
3,614,102 10/1971 Nikoden, Sr. .
3,752,139 8/1973 Asplund .
3,775,897 12/1973 Soulakis et al. .
3,822,583 7/1974 Keller et al. .
3,846,650 11/1974 Barrow .
3,865,373 2/1975 Knight .
3,891,869 6/1975 Scarpa .
3,919,987 11/1975 Haubner et al. .
3,964,701 6/1976 Kacerek .
4,002,155 1/1977 Harned et al. .
4,015,319 4/1977 Levine .
4,076,247 2/1978 Kim et al. .
4,096,735 6/1978 Huntzinger et al. ..... 73/35
4,111,035 9/1978 West et al. ..... 73/35
4,119,317 10/1978 Ohlund et al. .
4,129,299 12/1978 Busch ..... 273/372
4,157,798 6/1979 Lin .
4,161,665 7/1979 Buck et al. ..... 73/35 X
4,239,234 12/1980 Ward ..... 273/391
4,254,354 3/1981 Keem ..... 73/35 X
4,261,579 4/1981 Bowyer et al. ..... 273/372
4,275,586 6/1981 Gast et al. .
4,283,060 8/1981 Braunschweiler ..... 273/386 X
4,330,129 5/1982 Meredith .
4,393,687 7/1983 Muller et al. .
4,393,688 7/1983 Johnston et al. ..... 73/35
4,482,156 11/1984 Karlsson .
4,732,394 3/1988 Stein et al. ..... 273/391
4,979,752 12/1990 Fosseen ..... 273/392

55
59
57
73
75
21
21
27
21
47
13
15
43
81
77
37
21
19
79
41
21
29
45
31
33
92
53
71
69
25
83
97

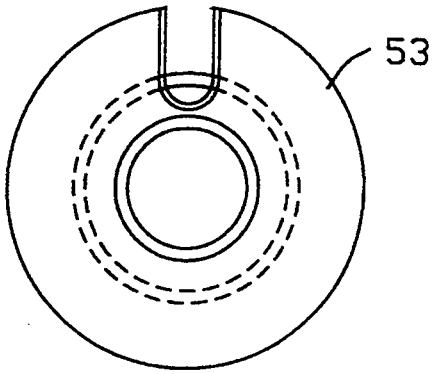
FIG. 9
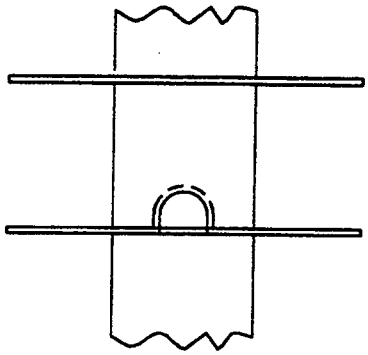
FIG. 9A
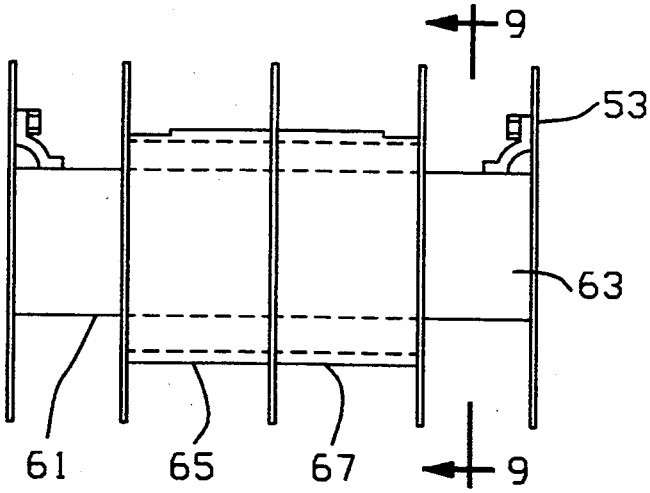
FIG. 10
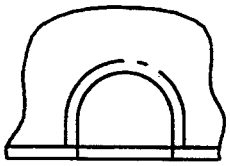
FIG. 9B
FIG. 11
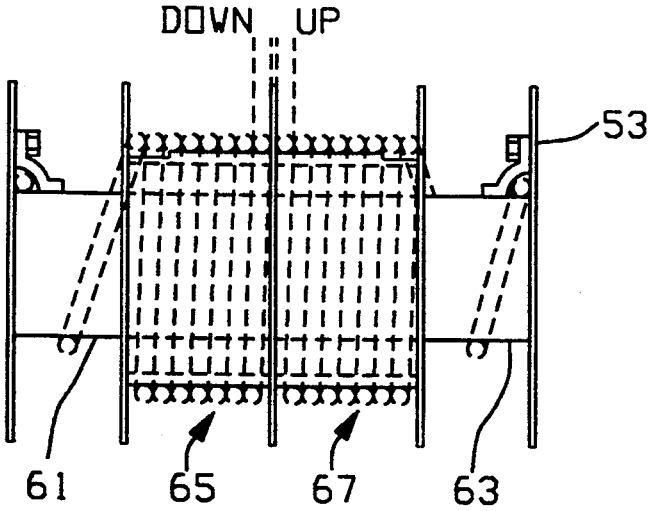

FIG. 12
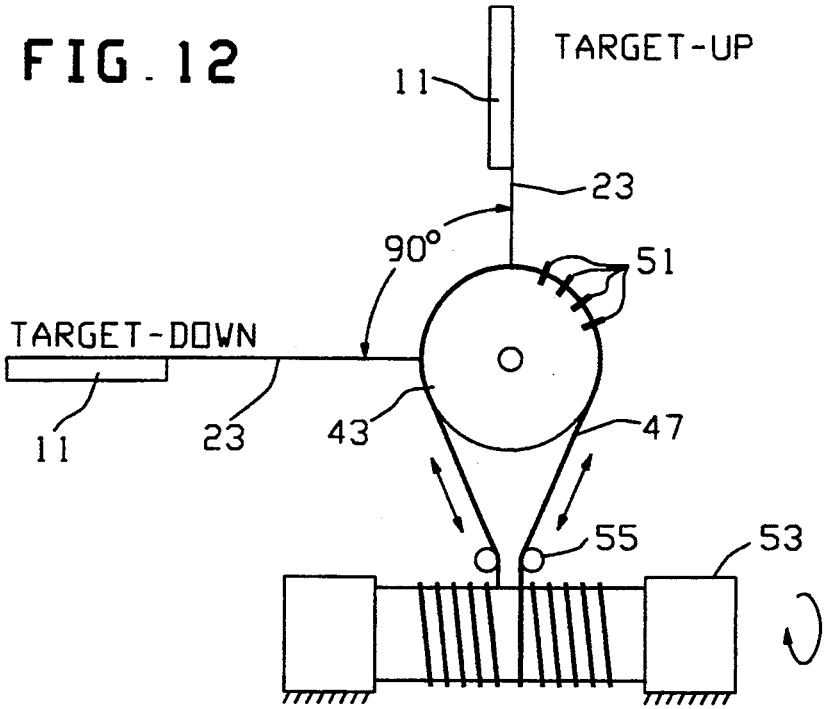
FIG. 13
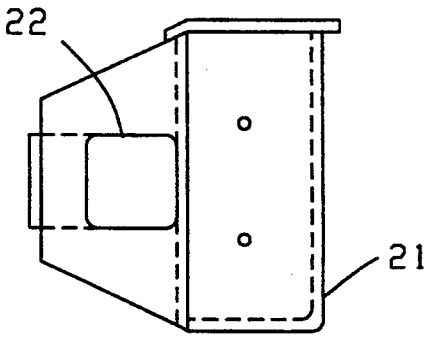
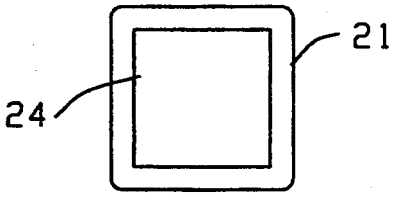
FIG. 15
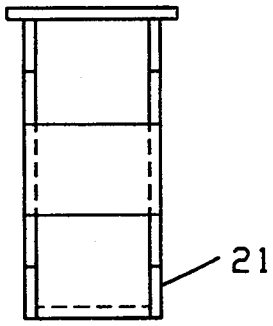
FIG. 14

TARGET LIFTER WITH IMPACT SENSING

FIELD OF THE INVENTION

The present invention relates to controlled raising and lowering such as of large objects. The present invention also relates to targets, and more particularly to handling or manipulation of same (e.g., target positioning means) and to target support structure. The present invention further relates to hit sensing for targets and the use of same to control target position. The invention further relates to devices for supporting planar or three-dimensional targets for use in target shooting.

BACKGROUND OF THE INVENTION

Targets have long been used for training. For example, a ground-based two-dimensional or three-dimensional target having an appearance similar to that of a tank can be used for training of crews of anti-tank guns or other artillery. By utilizing such targets, real-world battlefield efficiency of soldiers so trained is improved, by giving them practice in utilizing their equipment before they are called upon to use same in a more stressful situation where they may be under fire. Using of targets instead of, for example, an actual tank also reduces the cost of such training; it is cheaper to repair or replace a damaged target than it is to repair or replace a damaged tank.

Further cost savings can be achieved by having the target lowered when the target is hit. Such lowering also provides the trainee(s) with a good visual indication of the effectiveness of their fire. Obviously, it would be dangerous to have an observer positioned near a target to determine when that target has been hit and so should be dropped. Accordingly, a hit sensor is needed to determine whether the target has been hit such as by gunfire. For this purpose, a piezoelectric sensor has been fixed to a surface of the target facing the source of such gunfire. However, while such devices have served the purpose, they have not proven entirely satisfactory under all conditions of use in that the hit sensor so mounted is, like the target, subject to damage from gunfire or debris.

SUMMARY OF THE INVENTION

Accordingly, an object of the present invention is to provide a hit sensor that can both sense whether a target has been hit such as by gunfire, and is protected from same.

Another object of the present invention is to provide damping for a hit sensor.

A further object of the present invention is to provide a target that can be lowered in response to sensing of target hits.

Still another object of the present invention is to provide a target lifting mechanism that is capable of both raising a target to a position where it is available for use, and a lower position where the target is not so available.

A still further object of the present invention is to provide a target lifting mechanism which can lower a target to a position where it is not readily visible to a ground-based observer, in response to sensing of one or more hits on the target.

Briefly, these and other objects of the present invention are accomplished by a lifter that rotates or levers relatively large objects up and down. For example, a flat or three-dimensional target could be rotated up from a horizontal position near the ground to a raised, vertical position where it is readily visible. The target is mounted on supports. The supports are mounted on a single or multi-piece member (e.g. a rigid bar) that can be rotated on its longitudinal axis to cause observable raising and lowering of the target. This member is rotatably driven by a driver. One such driver includes a motorized winch, a wheel or pulley coaxially connected to the member (preferably at its midpoint), and a cable. The wheel is coaxially fixed to the member to which the target is connected. The cable is wrapped around the motorized winch in opposite directions, and is also wrapped around the wheel. Driving the winch thus causes the target to be rotated or levered up and down. The device can be operated by remote control. When the mechanism is used to so raise and lower targets on a firing range, the target can be dropped automatically when the target receives one or more hits. The hit sensor is mounted on a side or surface portion of the member opposite the side or surface portion of the member facing the target. The hit sensor thus faces downwards when the target is raised. The hit sensor preferably is an automobile or other internal combustion engine knock or detonation sensor. At least the portion of the member to which the hit sensor is connected is hollow and is filled with a liquid to provide damping for the sensor.

Other objects, advantages and novel features of the invention will become apparent from the following detailed description of the invention when considered in conjunction with the accompanying drawings.

BRIEF DESCRIPTION OF THE DRAWINGS

In the drawings,

FIG. 9 is a section of the winch of FIG. 10 taken on the line 9—9 and looking in the direction of the arrows;

FIG. 9A is a top view of a portion of the winch of FIGS. 9 and 10;

FIG. 9B is an enlarged view of a portion of FIG. 9A;

FIG. 10 is a side view of the winch of FIGS. 1, 2, 6, 7 and 8;

FIG. 11 is a side view similar to that of FIG. 10 but showing the cable windings on the winch;

FIG. 12 is a simplified diagram showing operation and relative cooperation of different parts of the device of FIGS. 1 and 2;

FIG. 13 is a side view of a target holder of FIG. 1 and FIG. 2;

FIG. 14 is a front view of the target holder of FIG. 13;

FIG. 15 is a top view of the topmost portion of the target holder of FIGS. 13 and 14;

DESCRIPTION OF THE PREFERRED EMBODIMENT

Figure 1:
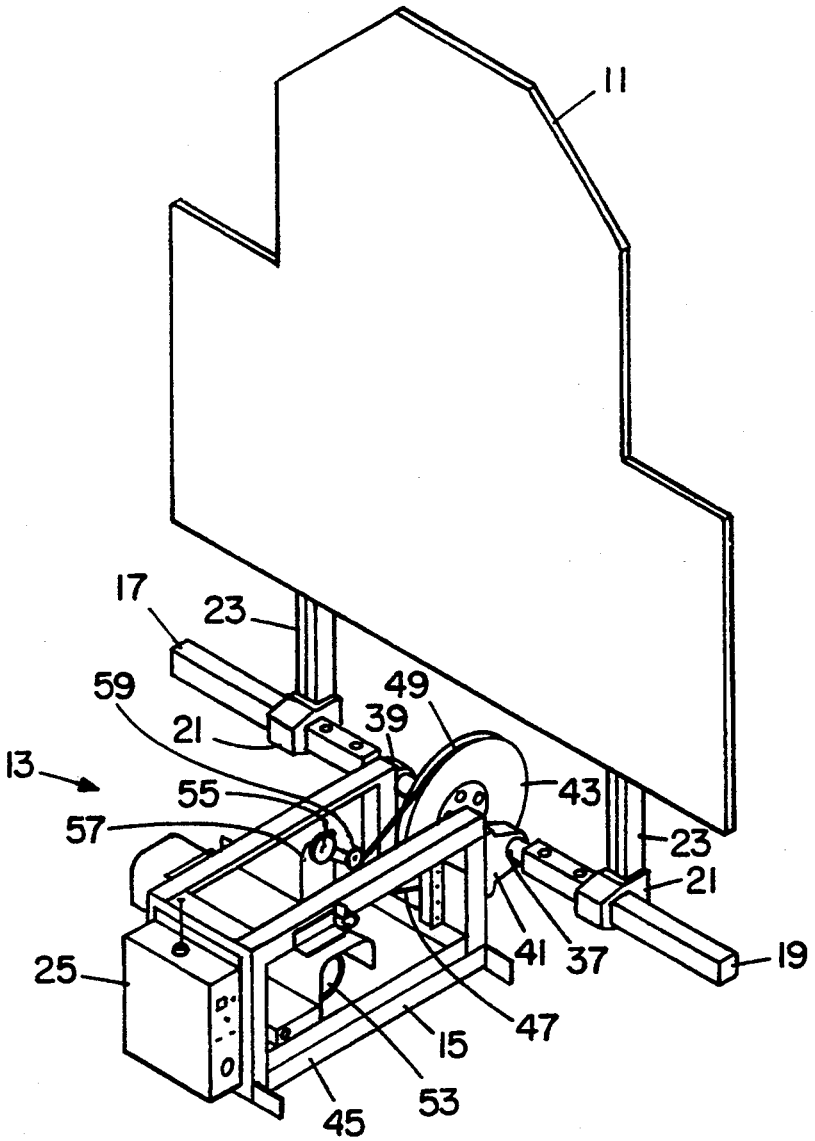
FIG. 1 is an isometric view of a preferred embodiment of a target lifting mechanism according to the present invention, illustrated with one embodiment of a target and target supports thereon in a raised position.
Figures 2, 2A, 2B, 2C:
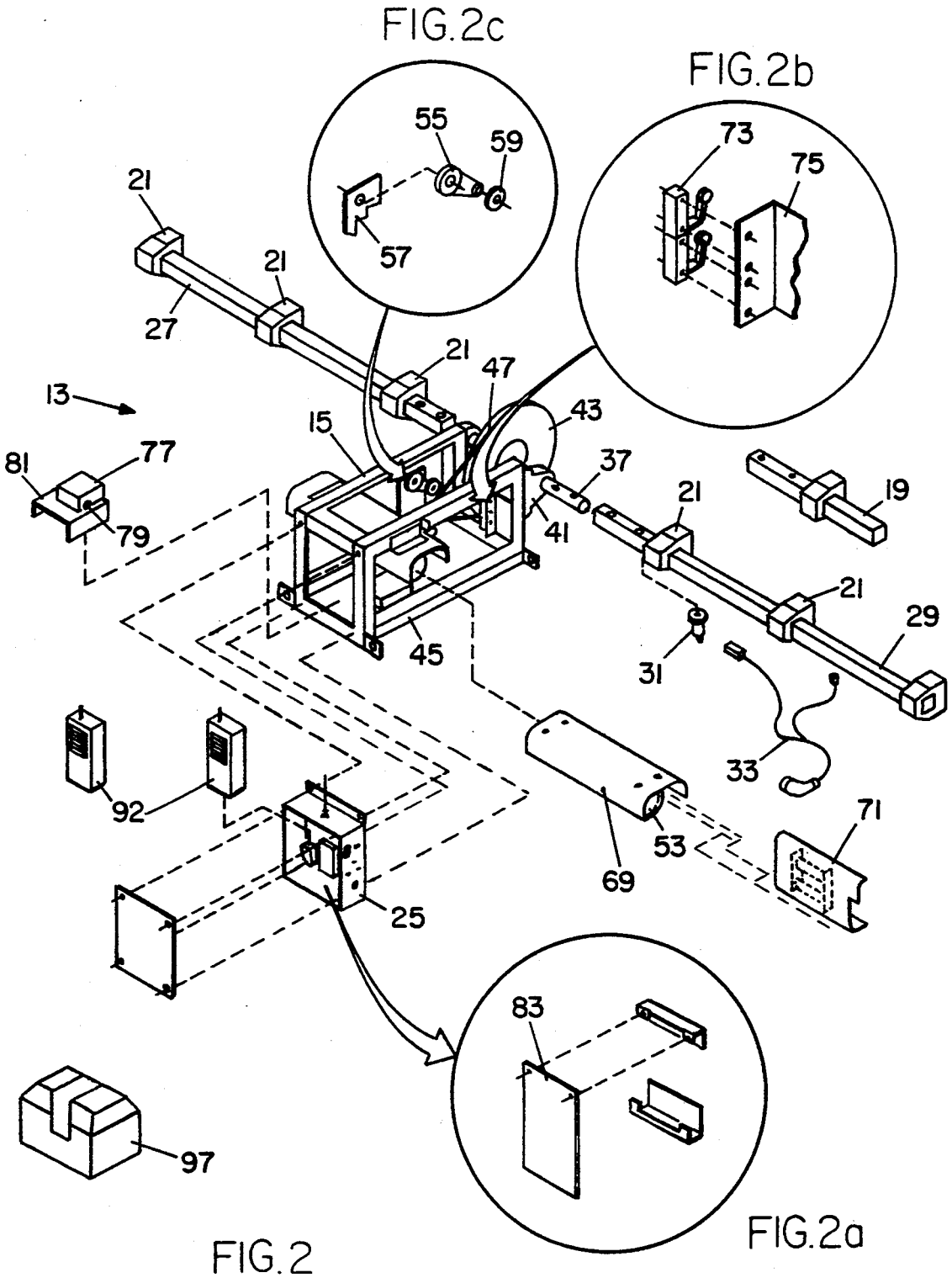
FIG. 2 is an exploded view of the target lifting mechanism of FIG. 1 but illustrated with a different number of target supports than is shown in FIG. 1.
FIG. 2*a* is an enlarged exploded view of a portion of FIG. 2 showing greater detail.
FIG. 2*b* is an enlarged exploded view of another portion of FIG. 2 showing greater detail.
FIG. 2*c* is an enlarged exploded view of still another portion of FIG. 2 showing greater detail.

Referring now to the drawings, wherein like reference characters designate like or corresponding parts throughout the several views, there is shown in FIG. 1 a target 11 mounted on, supported by and positioned by target lifting mechanism 13. Target lifting mechanism 13 includes drive assembly 15, short target arms 17 and 19, target holders 21, target supports 23, and electronics assembly 25. As shown in FIG. 2, long target arms 27, 29 can be substituted for short target arms 17, 19 of FIG. 1, to accommodate more target holders 21 and a larger target than are shown in FIG. 1. For example, a full-size two-dimensional plywood target whose outline corresponds to that of a battle tank would require six target holders 21 and six target supports 23 and would thus require use of long arms 27, 29. A preferred target holder 21 is illustrated in FIGS. 13, 14 and 15. Target holder 21 is provided with a side hole 22 through which a targert arm passes. Target holder 21 is also provided with a top opening 24 for a target support 23. Target holder 21 thereby physically connects a target arm and a target support at a right angle to each other. Supports 23 can be formed of wood, such as with a rectangular cross-section of 2 inches by 4 inches or 4 inches by 4 inches.

Figure 3:
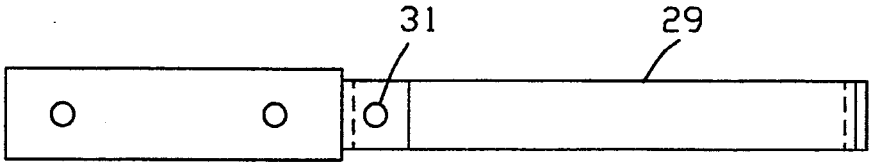
FIG. 3 is a bottom view of one embodiment of one portion of the device of FIGS. 1 and 2.
Figure 3A:
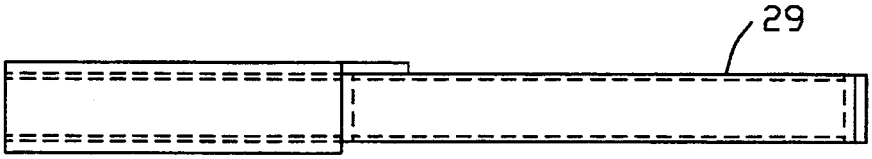

As illustrated in FIG. 3, a hit sensor 31 is mounted to the underside of long arm 19, and is connected to electronics assembly 25 via electrical cable 33. Hit sensor 31 is preferably a knock (detonation) sensor used to detect engine knock in automobile or other engines. General Motors piezoelectric knock sensor, Part Number 10456017 or 1997562, available from General Motors Corporation, Detroit, Mich., is preferred. Another example of such a knock sensor is described in U.S. Pat. No. 4,393,688 entitled "Piezoelectric Knock Sensor" issued Jul. 19, 1993 to Daniel U. Johnston et al.

Figure 4:
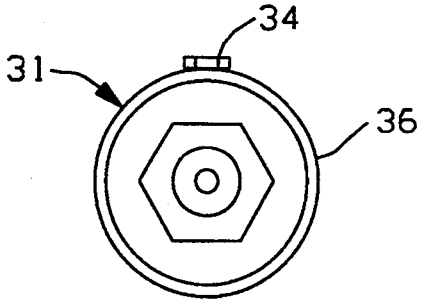
FIG. 4 is a bottom view of one embodiment of a hit sensor that can be utilized in the device of FIGS. 1 and 2.

The exterior of FIGS. 1 and 4 of the Johnston et al. patent appear to be similar to the exterior of the above-identified General Motors knock sensor. That patent discloses a knock sensor for an internal combustion engine comprising, in combination: a mounting element adapted for rigid attachment to the engine; a flexing plate supported on the mounting element and adapted to execute plate vibrations in response to knock events in the engine, the plate having a surface comprising a plurality of raised radial ridges; a piezoelectric disk affixed to the surface of the plate for flexure with vibrations thereof in abutment with the radial ridges by means of an adhesive substance between the raised radial ridges, said ridges providing internal electrical ground contact for one surface of the piezoelectric disk through the plate, mounting element and engine, as well as strain transmission between the plate and the disk; a cover affixed to the periphery of the plate, the cover including an electric output terminal; and spring means compressed between the cover and the other surface of the piezoelectric disk, said spring means being in electrical contact with the electric output terminal, the radial arrangement of said ridges permitting radial outflow of excess adhesive to permit the spring means to force the piezoelectric element into contact with said ridges, whereby good internal electrical ground contact in the sensor is assured. The Johnston et al. patent also discloses a knock sensor for an internal combustion engine comprising, in combination: a mounting element adapted for rigid attachment to the engine; a flexing plate supported on the mounting element and adapted to execute plate vibrations in response to knock events in the engine, the plate having a surface comprising a plurality of radial grooves with a raised radial ridge on each side thereof; a piezoelectric disk affixed to the surface of the plate for flexure with vibrations thereof in abutment with the radial ridges by means of an adhesive substance between the raised radial ridges, said ridges providing internal electrical ground contact for one surface of the piezoelectric disk through the plate, mounting element and engine as well as strain transmission between the plate and the disk; a cover affixed to the periphery of the plate, the cover including an electrical output terminal; and spring means compressed between the cover and the other surface of the piezoelectric disk, said spring means being in electrical contact with the electric output terminal, the radial arrangement of said ridges permitting radial outflow of excess adhesive to permit the spring means to force the piezoelectric element into contact with said ridges, whereby good internal electrical ground contact in the sensor is assured. In the present invention, either such knock sensor (or both) is rigidly attached to a target arm instead of to an internal combustion engine. Such a sensor would execute plate vibrations in response to artillery shell impacts or other gunfire impact events, instead of in response to knock events in the engine.

Nonetheless, identical flexing plates could be used for both applications. Electrical ground or return is provided for such a sensor not via the engine, but by soldering a ground lug 34 to the case 36 of the sensor, and by providing a ground or return line in electrical cable 33 in addition to a line for the sensor output. Lug 34 is connected to this ground or return line.

Other knock sensors that could be so utilized are Chrysler Part Number 4111526, Chrysler Part Number 4318118, Chrysler Part Number 5213629 (available from Chrysler Corporation, Highland Park, Mich.), and the knock sensor described in U.S. Pat. No. 4,254,354 entitled "Interactive Piezoelectric Knock Sensor" issued Mar. 3, 1981 to John E. Keem. Alternatively, a magnetostrictive knock sensor could be utilized as hit sensor 31. Such a magnetostrictive sensor could be that described in U.S. Pat. No. 4,096,735 entitled "Engine Detonation Sensor with Double Shielded Case" issued Jun. 27, 1978 to Gerald O. Huntzinger et al., or the sensor described in U.S. Pat. No. 4,161,665 entitled "Magnetostrictive Engine Detonation Sensor" issued Jul. 17, 1979 to Charles E. Buck et al. Also see U.S. Pat. No. 4,111,035 entitled "Engine Knock Signal Generating Apparatus with Noise Channel Inhibiting Feedback" issued Sep. 5, 1978 to Gene A. West et al. In the patent to West et al., column 3, line 65 through column 4, line 24 is particularly noted, referring at column 4, lines 13–16 to the above-identified Huntzinger et al. patent. The above-identified patents to Johnston et al., Keem, Huntzinger et al., Buck et al. and West et al. are each hereby incorporated by reference herein.

Figure 5:
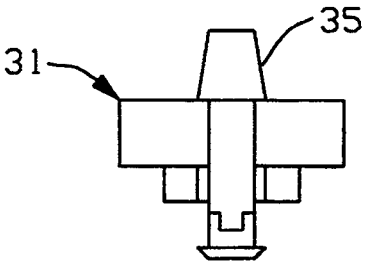
FIG. 5 is a side view of the hit sensor of FIG. 4.
Figure 6:
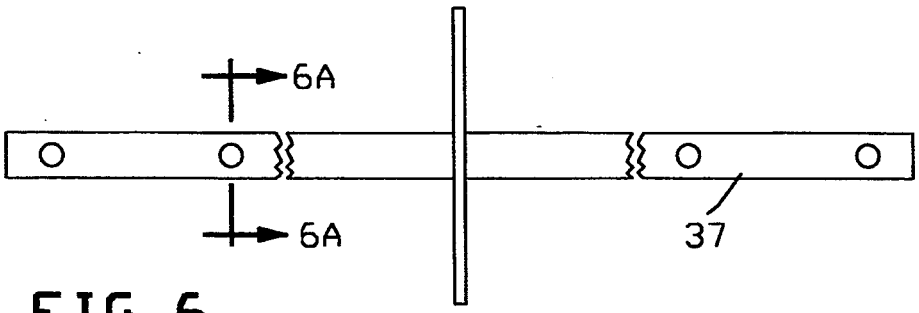
FIG. 6 illustrates a shaft that is a portion of the device of FIGS. 1 and 2 and is connected to the portion of FIG. 3.
Figure 3B:
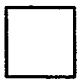
Figure 6A:
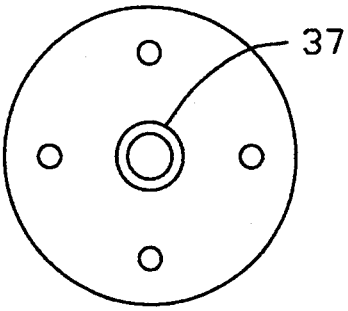
FIG. 6A is a section of the apparatus of FIG. 6 taken on the line 6A—6A and looking in the direction of the arrows.
Figure 7:
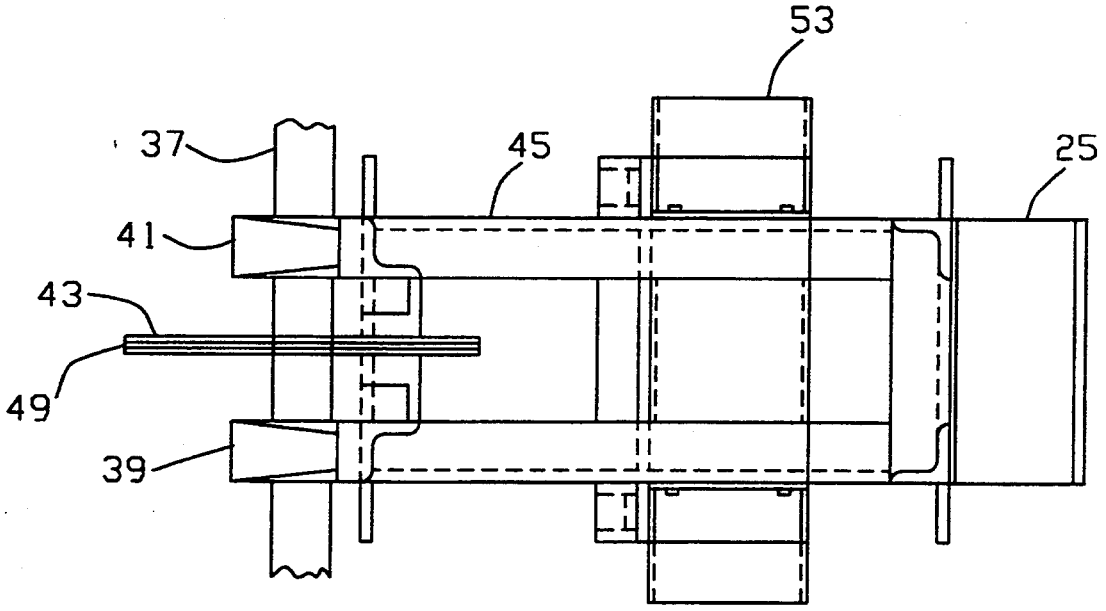
FIG. 7 is a top view of the mechanism frame of FIGS. 1 and 2 shown with the mechanical cable removed.

A preferred piezoelectric automotive knock sensor utilized as hit sensor 31 is illustrated in FIGS. 4 and 5. Threaded end 35 of hit sensor 31, shown in FIGS. 4 and 5, is inserted into arm 29. The location of hit sensor 31 on target lifting mechanism 13 is illustrated in FIGS. 2 and 3. Although therein hit sensor 31 is shown mounted on arm 29, a hit sensor can be mounted on any of arms 17, 19, 27 and 29. If desired, two hit sensors could be utilized in target lifting mechanism 13, respectively connected to each of arms 17 and 19 or to each of arms 27 and 29, on either side of wheel drive assembly 15. In this manner, when target 11 is in a raised position, the exposed portion of hit sensor 31 is directed downwards, and is thereby at least relatively protected from damage from gunfire and resulting debris to which target 11 is to be subjected.

Because the preferred General Motors piezoelectric knock sensors have proven too sensitive to be used alone for hit sensing, even with the separation from the target provided by the target support(s), target holder(s) and target arm(s), these sensors are damped in the following manner. Each arm 17, 19, 27, 29 to which a hit sensor is connected is provided with a hollow enclosed cavity, closed by an end plug or by other suitable means. After insertion of threaded portion 35 into a suitably threaded hole of that arm, the cavity is filled with a suitable fluid for damping. This hole communicates with the cavity. It is preferred that the entirety of the arm be so hollow and so filled, except for the portion of the arm into which shaft 37 fits. Kerosene or heating oil No. 1 or No. 2 are preferred for environmental reasons, but hydraulic fluid could be used instead. Kerosene or heating oil No. 1 or No. 2 are preferred because, unlike hydraulic fluid, they would likely evaporate in the event of a leak, a rupture or removal of a hit sensor. However, while gasoline would also likely evaporate under such circumstances, use of gasoline is not preferred because of its hazardous nature in this environment; a rupture or impact could lead to an explosion. Water is not preferred because it could freeze if the weather is sufficiently cold, causing bursting of the target arm containing the water. The liquid used should be sufficiently viscous to damp and thereby mask vibrations other than those caused by hits such as by artillery shells or bullets. If the target used is sufficiently large to necessitate use of long target arms 27 and 29, then use of two hit sensors, one in each such arm, would be preferred, to ensure sensing of hits in any part of the target.

Figure 8:
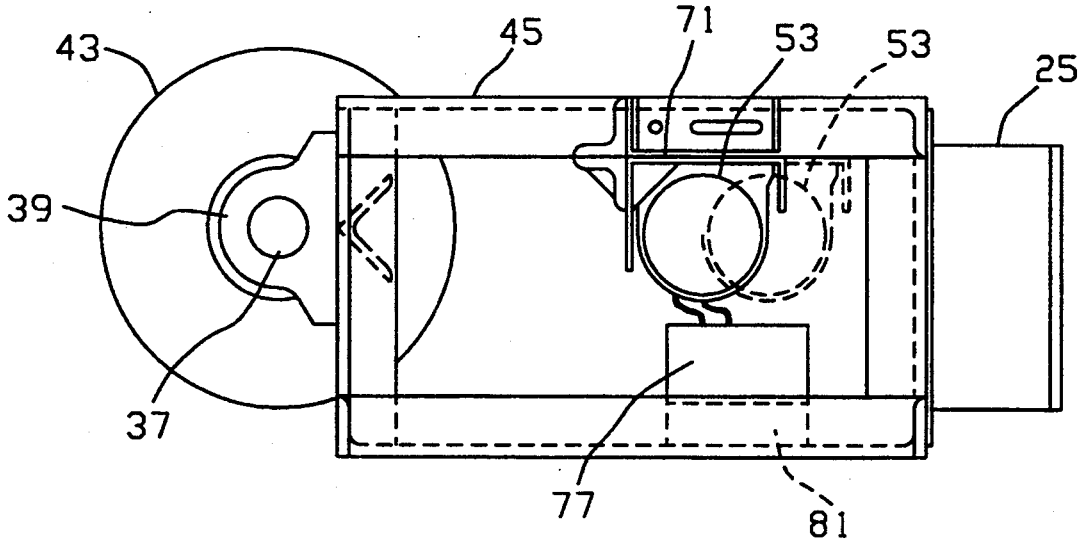
FIG. 8 is a side view of the mechanism frame of FIGS. 1, 2 and 7 but with the mechanical cable removed.
Figure 12A:
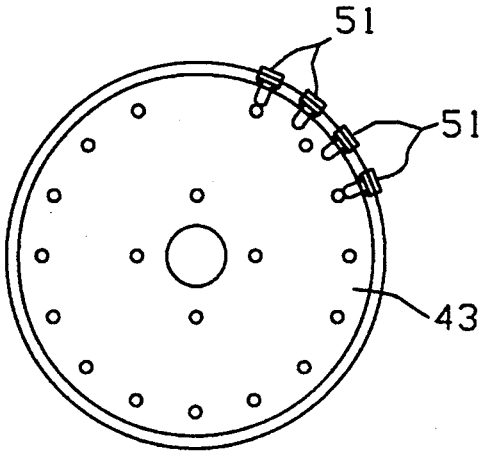
FIG. 12A shows the wheel.
Figure 12D:
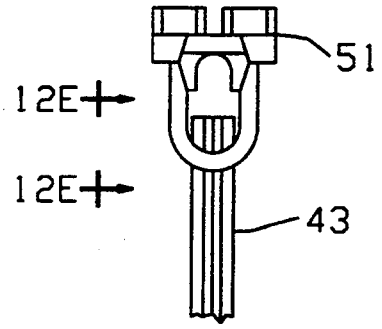
FIG. 12D is a section of the wheel of FIG. 12C taken on the line 12D—12D of FIG. 12C and looking in the direction of the arrows.
Figure 12B:
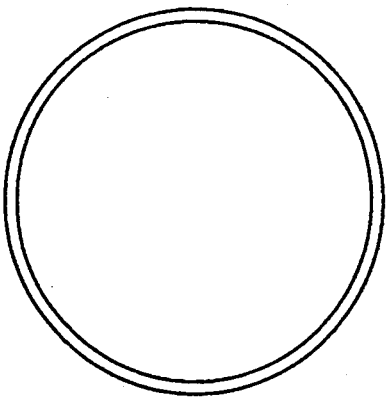
FIG. 12B illustrates either of two cover plates for the wheel of FIG. 12A.
Figure 12E:
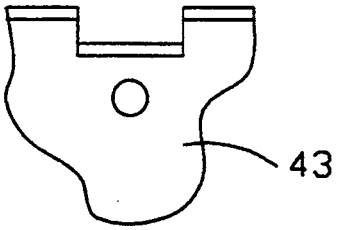
FIG. 12E is a section of the wheel of FIG. 12D taken on the line 12E—12E of FIG. 12D and looking in the direction of the arrows.
Figure 12F:
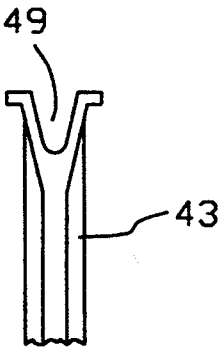
FIG. 12F is a section of the wheel of FIG. 12C taken on the line 12F—12F of FIG. 12C and looking in the direction of the arrows.
Figure 12C:
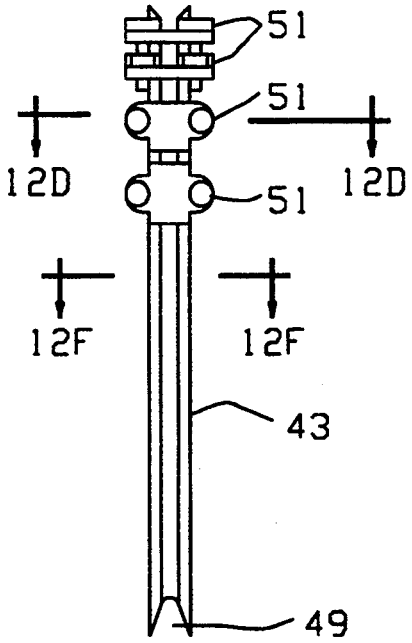
FIG. 12C is an edge or side view of the wheel of FIG. 12A.

Drive wheel assembly 15 includes drive shaft 37, bearings 39 and 41, wheel 43 and rigid frame 45. Frame 45 is fixed or anchored to the ground or to a base. Wheel 43 has a grooved edge to better contact mechanical cable 47. Each arm to be provided with a hit sensor 31 includes a sealed or sealable hollow cavity to be filled with a suitable damping fluid such as kerosene. Each end of shaft 37 is connected to a target arm. Each target arm is configured to slip over a portion of shaft 37; shaft and arm can then be connected such as by two sets of bolts, nuts and washers as illustrated in FIG. 2. Bearings 39 and 41 are each fixed to frame 45. Bearings 39 and 41 support shaft 37 above the ground, and permit ready rotation of shaft 37. As shown in FIGS. 1, 2, 7 and 11, wheel 43 is coaxially fixed at its center to shaft 37 to drive the shaft. Wheel 43 in turn is driven by mechanical cable 47. Wheel 43 is provided with a groove 49 to receive cable 47. Cable 47 is connected to wheel 43 by anchors 51. Cable 47 is driven by motorized winch 53. Winch 53 can for example be a Ramsey Front Mount Electric Winch, Model REP 8000, available from Ramsey Winch Company, Tulsa, Okla. and described in "Ramsey Winch Company OWNERS MANUAL, Front Mount Electric Winches, Model REP 5000, Model REP 6000, Model REP 8000, Model REP 8000X" (Ramsey Winch Company, Tulsa, Okla., October 1991) which is hereby incorporated by reference herein. Use of the Ramsey Model REP 8000 winch is preferred. That winch incorporates a planetary gear drive in the mechanism and a friction brake. The friction brake allows the target to lower under large wind or snow loads, and reduces loads on the planetary gears when the winch is not under power. In the practice of the present invention, a middle portion of the outer diameter of the Ramsey Model REP 8000 winch drum is increased from 2½ inches to 4½ inches. This modification of winch 53 is shown in FIGS. 9 and 10. As shown in FIG. 8, the position of winch 53 with respect to wheel 43 and shaft 37 can be changed to adjust the tension on cable 47. This tension can also be adjusted by two adjustable spring-loaded tensioners or tension arms, of which only one (arm 55) is shown in FIGS. 1 and 2. The two adjustable tension arms can be used to pinch or at least press on cable 47 inwards to increase the tension on the cable. Any such pinching would also permit a greater distance between winch 53 and wheel 43. The tension arms are loaded with 300 pound (force) springs to take up any slack in cable 47 such as when direction of movement of cable 47 reverses. Tension arm 55 is connected to frame 45 via a metal support member 57. Tension arm 55 is provided at its end contacting cable 47 with a rotatable tension arm wheel 59, to readily permit movement of cable 47 past tension arm 55. Cable 47 can also be crossed between winch 53 and the two tension arms. As shown in FIG. 11, cable 47 is counterwound on winch 53. Each end of cable 47 is anchored to a respective end of winch 53. Cable 47 is anchored at its ends to the respective outboard ends of each smaller diameter portion 61, 63 respectively, is wrapped once or twice about each smaller-diameter winch drum portion 61, 63 of winch 53, and is wrapped six or seven times about each of larger-diameter winch drum portion 65, 67 before being led off from winch 53 to pass over wheel 43. Some or all of the cable in these wraps can be unwrapped from one side of winch 53 toward wheel 43 by rotation of the winch and resulting rotation of wheel 43. Thus, as shown in FIG. 12, rotation of winch 53 in one rotary direction raises target 11, while rotation of winch 53 in the opposite rotary direction will cause lowering of target 11.

Although the hit sensing and target control of the present invention could be used with a hydraulic system or a gear train instead of drive assembly 15 to rotate shaft 37, drive assembly 15 is preferred. Drive assembly 15 is lightweight, relatively inexpensive, uses relatively less power, moves the target relatively quickly (e.g. 6 seconds or less between the vertical raised position of FIG. 1 and a horizontal lowered position), and avoids loss of power from hydraulic leaks. Hydraulics would also pose greater maintenance and reliability problems and greater environmental hazards than does drive assembly 15.

Figure 16:
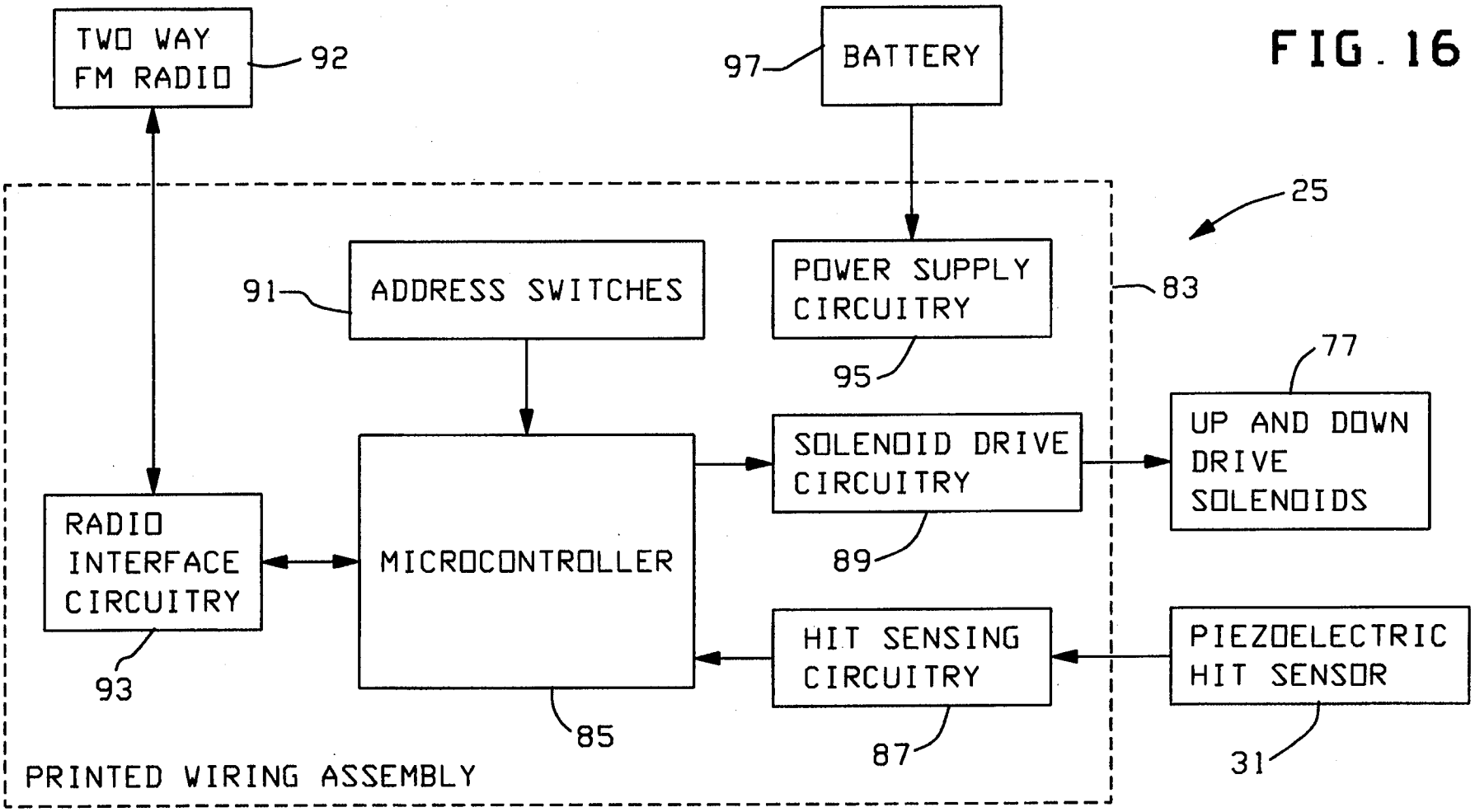
FIG. 16 is a block diagram of the electronics of the device of FIGS. 1 and 2.
Figure 20:
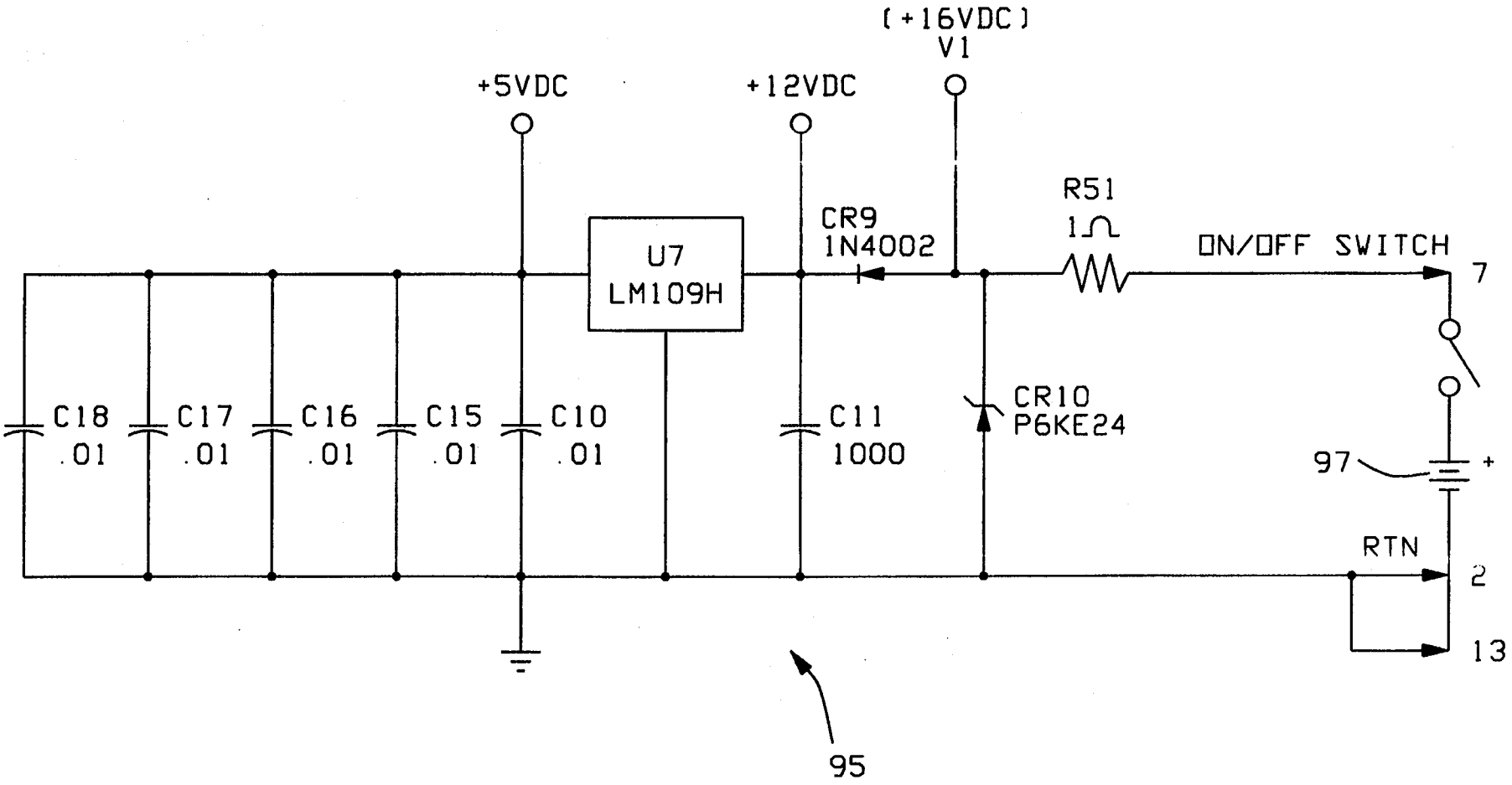
FIG. 20 is a schematic diagram of the power supply circuitry of FIG. 16.

Drive assembly 69 includes winch 53 and fairlead tensioner plate 71. A limit switch array 73 is connected to frame 45 via bracket 75. Cable 47 is preferably a steel aircraft cable 20 feet long and 5/16 inch in diameter, for sufficient strength. 12 VDC solenoid assembly 77 and 2 amp fast blow fuse 79 are connected to frame 45 via bracket 81. Electronics assembly 25 includes a printed wiring assembly 83. A block diagram for electronics assembly 25 is given in FIG. 16. Printed wiring assembly 83 contains a microcontroller 85, hit sensing circuitry 87, solenoid drive circuitry 89, address switches 91 and radio interface circuitry 93. Microcontroller 85 is connected to, and controls or responds to, each of components 87, 89 and 93. Microcontroller 85 is also connected to component 91. Power supply circuitry 95 of FIG. 20 supplies power to the rest of printed wiring assembly 83 from a suitable battery 97 such as a charged automobile electric storage battery. Power provided by power source 97 is preferably at 12 volts DC. Any signals from the hit sensor(s) are provided via cable 33 to hit sensing circuitry 87. Radio interface circuitry 93 permits remote control of winch 53 and thus of the position of target 11. A set of address switches 91 are provided with, and are used to uniquely identify, each drive assembly 15. Address switches 91 are thus particularly useful when several such drives are being individually remotely controlled such as from two-way FM radio 92.

Figure 17:
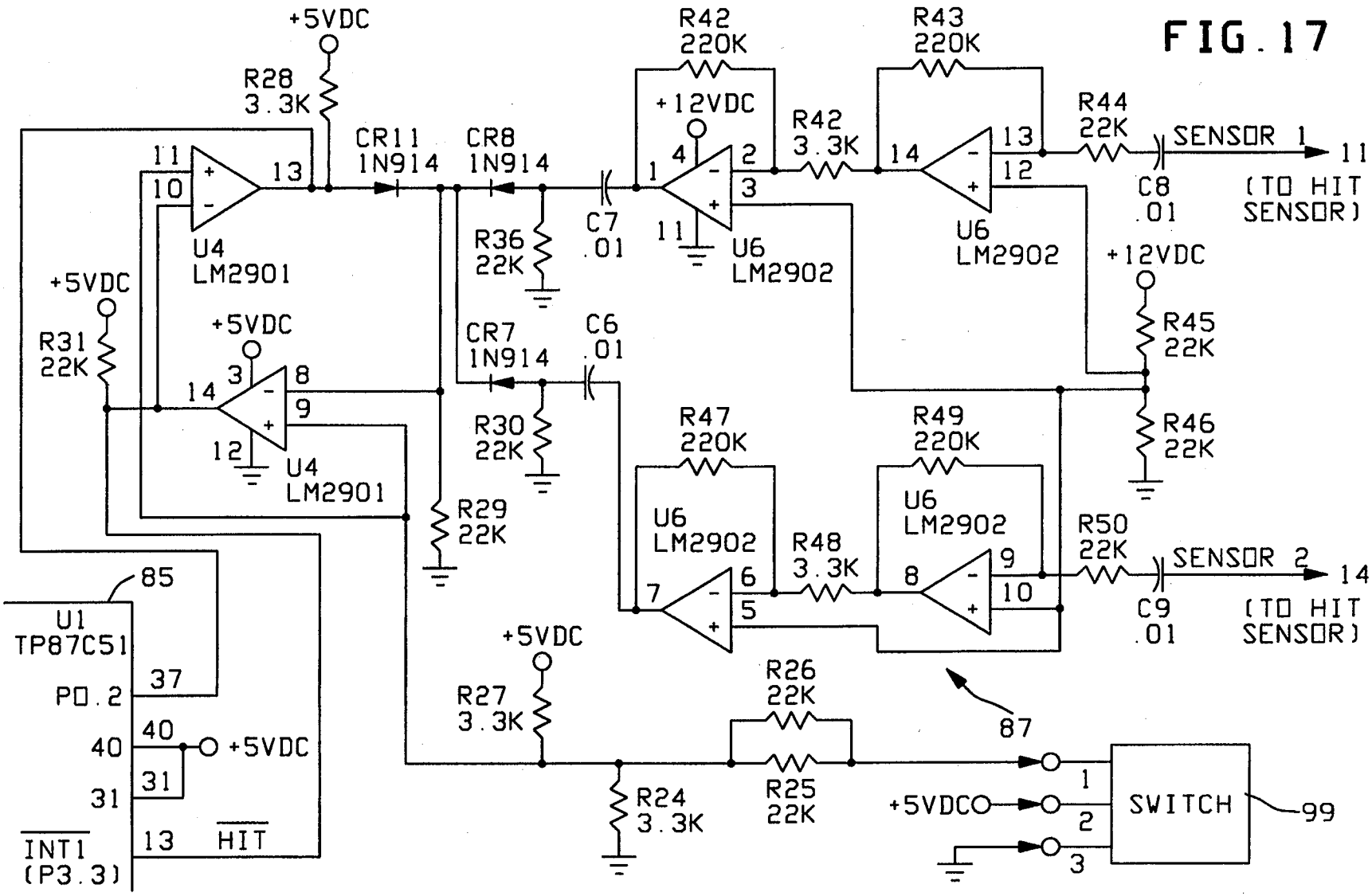
FIG. 17 is a schematic diagram of the hit sensor utilization circuitry of FIG. 16.
Figure 18:
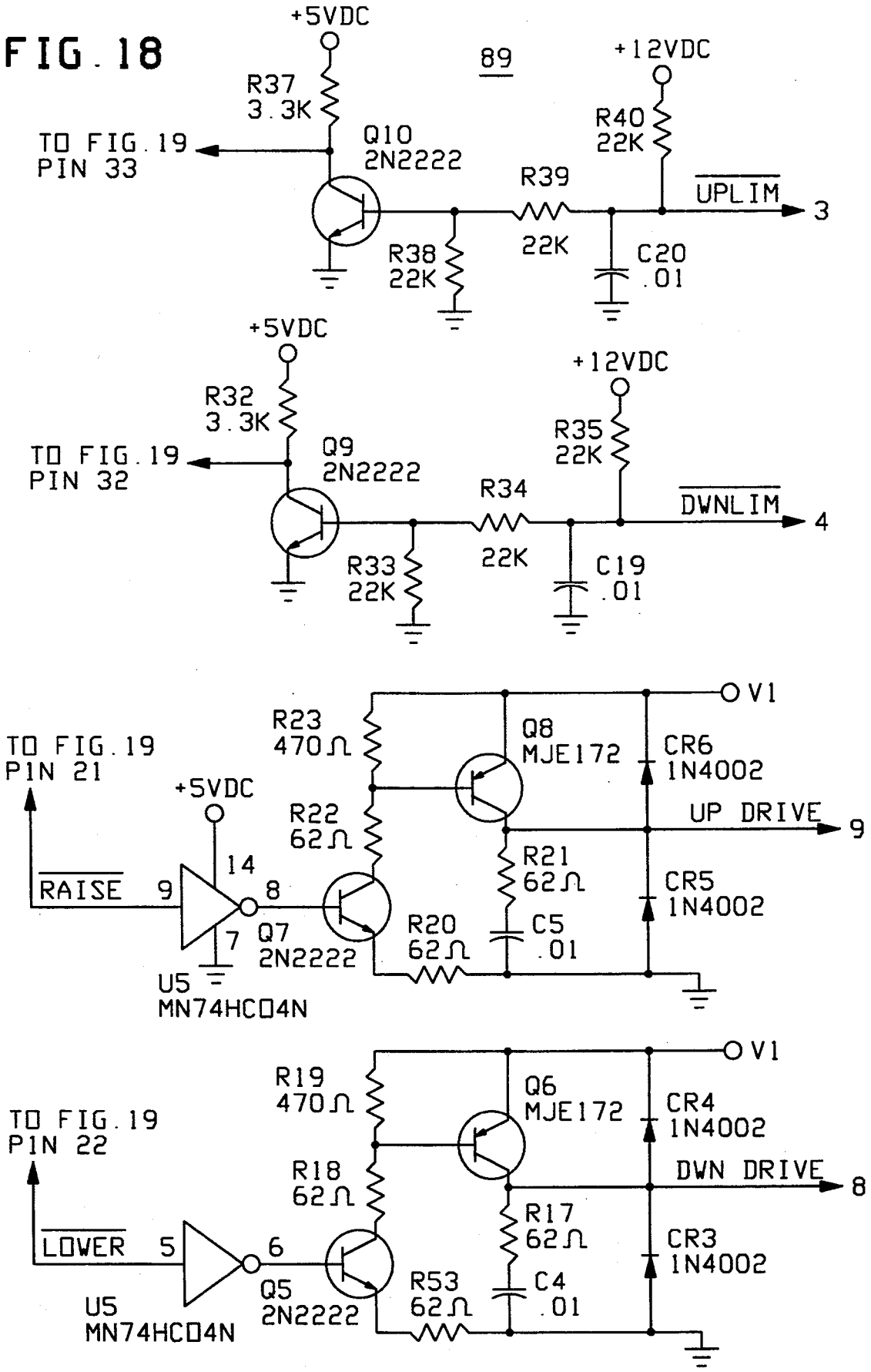
FIG. 18 is a schematic diagram of the solenoid control circuitry of FIG. 16.

Hit sensing circuitry 87 is illustrated in greater detail in FIG. 17. SENSOR 2 pin 14 is wired to knock sensor 31 threaded into right target arm 29 of FIG. 2. SENSOR 1 pin 11 is wired to a similar knock sensor (not shown) threaded into the left target arm 27 of FIG. 2. In response to signals from hit sensing circuitry 87, microcontroller 85 provides control signals to solenoid drive circuitry 89 to control the up and down drive solenoids (located in assembly 77) of motorized winch 53. Limit switch array 73 includes an up limit switch and a down limit switch. These limit switches are used to sense whether preset desired extreme positions of target 11 have been reached. These limit switches are preferably heavy-duty industrial grade switches with roller arms. Solenoid drive circuitry 89 is illustrated in greater detail in the schematic diagram of FIG. 18. UP DRIVE pin 9 is wired in series with the normally closed (NC) contacts of the up limit switch in array 73 to the up drive solenoid coil of winch 53. When target 11 reaches its up position, the normally closed contacts of the up limit switch open and voltage is removed from the up drive solenoid coil. UPLIM pin 3 is connected to the normally open contact of the up limit switch. Whenever a preset up limit for target 11 is reached, switching the up limit switch, this pin 3 is grounded through the low impedance solenoid coil, transistor Q10 turns off, and microcontroller 85 detects a high level at its P0.6 pin 33. Microcontroller 85 will then remove the up drive. DWN DRIVE pin 8 is wired in series with the normally closed contacts of the down limit switch electrically connected to the down drive solenoid coil of winch 53. The up drive solenoid coil and the down drive solenoid coil for winch 53 are both located in solenoid assembly 77. When target 11 reaches its preset desired down position, these normally closed contacts open and voltage is removed from the down drive solenoid coil of winch 53. DWNLIM pin 4 is wired to the normally open contact of the down limit switch. Whenever a preset down limit for target 11 is reached, this pin 4 is grounded through the low impedance solenoid coil, transistor Q9 turns off, and microcontroller 85 detects a high voltage on pin 32. Microcontroller 85 then removes the down drive in response.

Figure 19:
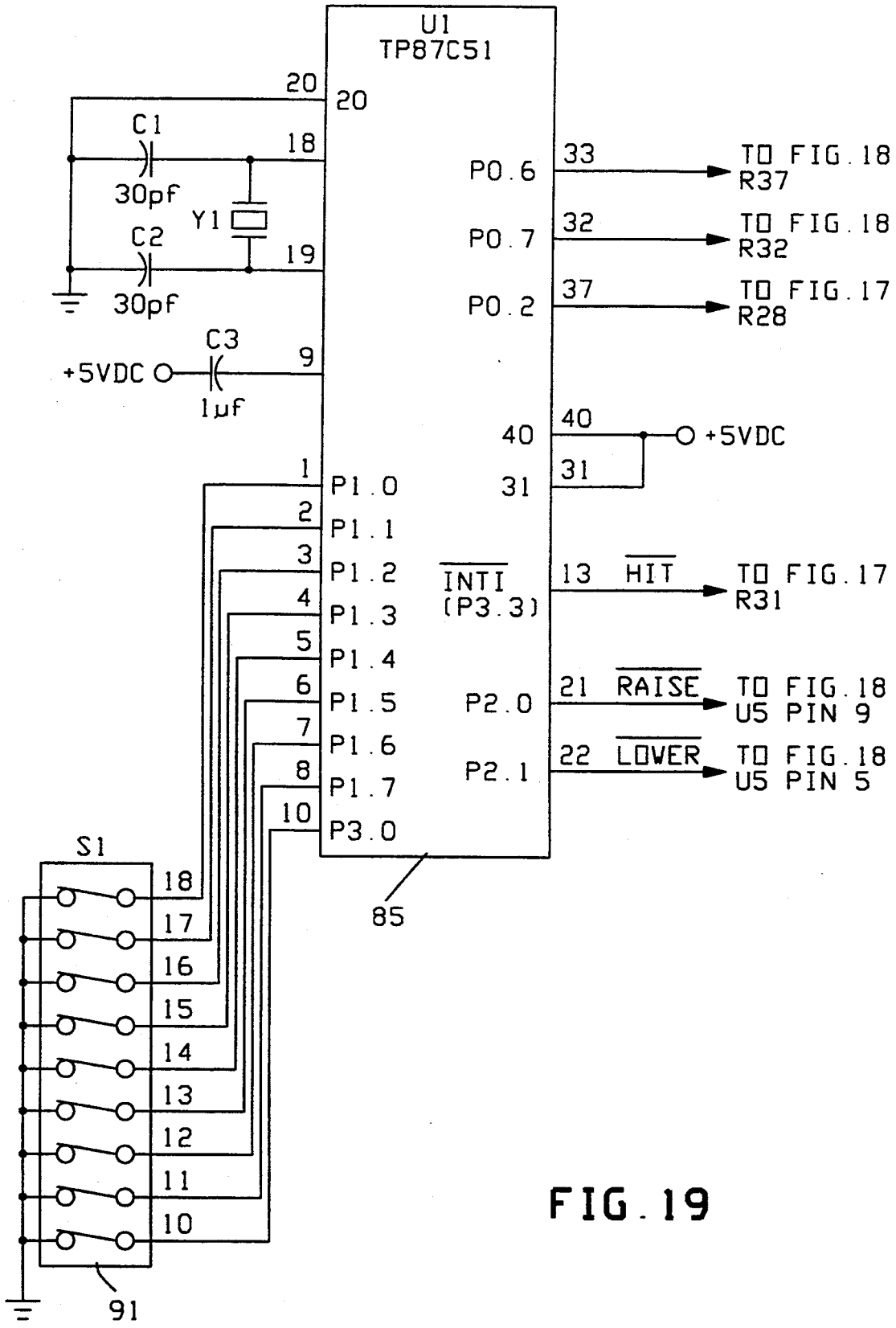
FIG. 19 is a diagram of connections to a preferred mirocontroller that can be utilized as the microcontroller of FIG. 16.

Microcontroller 85 can for example be an Intel TP87C51 microcontroller, connected as shown in FIG. 19. The U6 op amps of FIG. 17 can for example each be one of the four amplifiers of an LM2902 quad operational amplifier. The U4 comparators of FIGS. 17 and 18 can for example each be one of the comparators of an LM2901 quad comparator. Device U8 of FIG. 20 can for example be an LM117K adjustable regulator. Address switches 91 can for example be implemented by a 9 position DIP switch, AMP part number 435640-6. Some pin numbers given herein and in FIGS. 17, 18, 19 and 20 correspond to the pin numbers for these devices.

In hit sensor circuitry 87, quad op amp U6 provides amplification for the knock sensor signals. No electronic damping is provided by circuitry 87. Damping is accomplished mechanically, by filling the hollow target arms with kerosene or other suitable fluid. Rubber may harden or become brittle from age or weather, and is not preferred for this purpose. The two identical knock sensors are each threaded into a respective target arm. Resistors R42 and R48 each set the gain for a respective hit sensor. The preferred value for R42 and for R48 was determined experimentally to be 150K ohms for a total gain of about 15. The sensitivity of the hit sensor circuitry 87 is changed by changing the reference voltage applied to pin 2 of FIG. 17 by triple-throw "on-off-on" switch 99. Switch 99 need not be on electronics assembly 83. Switch 99 is connected to pin 2, and can switch between pin 1, open circuit, and pin 3. The three possible positions of switch 99 thus provide respective reference voltages of +5 VDC, open circuit, and ground. By providing selective intensity, the present invention is capable of detecting hits from direct fire weapons of calibers 12.7 mm through 120 mm.

Some of the many advantages of the invention should now be readily apparent. For example, a novel target lifter with hit sensing has been provided that is capable of raising and lowering a target between an exposed upper position and a more concealed lower position. The lifter is capable of lifting heavy objects (e.g. weighing 350 pounds). Although it is preferred that the frame be anchored while in use, the lifter is relatively small and is portable if necessary. Hit sensing capability has been provided to permit movement of the target from the upper position to the lower position to indicate hit or "destruction" of the target without needing to actually physically destroy the target. The hit sensor(s) can sense whether a target has been hit such as by gunfire, but is protected from same. The target can be lowered in response to sensing of target hit(s). Also, the target supports, target holders and target arms physically separate the hit sensor(s) from the target to protect the hit sensor(s) from damage, while still physically connecting the hit sensor(s) to the target so that the hit sensor(s) can detect target hits. When a projectile hits the target, a shock wave is transmitted to the hit sensor via the target, target supports and target holders and through the liquid filled target arm. The liquid dampens the signal so that the knock sensor outputs are usable. The sensor is mounted below the target and out of harm's way, which increases sensor life. Damping has been provided for the hit sensor to prevent false signals from being detected as target hits. Such false signals can be produced by noise, wind, blown dust, pebbles, branches, rocks, or animals. Electronic capability has been provided to adjust the sensitivity of the system, depending on the caliber of weapons being so used for target practice. The target holder does not clamp the wooden upright or target support, but simply accepts the support by a slip fit. A nail may be used to secure the support if desired. The holder also slides onto the target arm.

Obviously, many modifications and variations of the present invention are possible in light of the above teachings. It is therefore to be understood that the foregoing embodiments are presented by way of example only and that, within the scope of the appended claims and equivalents thereto, the invention may be practiced otherwise than as specifically described.

What is claimed is:

1. Apparatus for positioning of a target, comprising:

a rigid member including a first cavity filled with a liquid, said member having an axis;

support means for rotatably supporting said member such that said member can be rotated about its axis;

driving means for causing said member to rotate about its axis;

mounting means for physically connecting said member to a target and spacing said member from the target such that axial rotation of said member causes movement of the target, and such that a first surface portion of said member faces the target;

first sensing means, connected to said first cavity at a second surface portion of said member, for sensing any impacts on the target, wherein said liquid damps sensitivity of said sensing means; and control means, responsive to said sensing means, for controlling operation of said driving means, whereby one or more impacts on the target that are sufficiently large to overcome damping by said liquid cause movement of the target by said driving means.

2. Apparatus as defined in claim 1 wherein said liquid is selected from the group consisting of kerosene, No. 1 heating oil, and No. 2 heating oil.

3. Apparatus as defined in claim 1 wherein said liquid is sufficiently viscous to damp noise, wind, sand and debris, while permitting said sensing means to detect impact of a gunfire projectile on the target.

4. Apparatus as defined in claim 1 wherein said sensing means comprises an internal combustion engine knock sensor.

5. Apparatus as defined in claim 4 wherein said liquid is sufficiently viscous to damp noise, wind, sand and debris, while permitting said sensing means to detect impact of a gunfire projectile on the target.

6. Apparatus as defined in claim 5 wherein said knock sensor is a piezoelectric knock sensor.

7. Apparatus as defined in claim 5 wherein said knock sensor is a magnetostrictive knock sensor.

8. Apparatus as defined in claim 1 wherein said first sensing means comprises:

a mounting element for rigid attachment to the member;

a flexing plate supported on the mounting element and adapted to execute plate vibrations in response to impact events on the target, the plate having a surface comprising a plurality of raised radial ridges;

a piezoelectric disk affixed to the surface of the plate for flexure with vibrations thereof in abutment with the radial ridges by means of an adhesive substance between the raised radial ridges, said ridges providing internal electrical ground contact for one surface of the piezoelectric disk through the plate and mounting element, as well as strain transmission between the plate and the disk;

a cover affixed to the periphery of the plate, the cover including an electric output terminal; and spring means compressed between the cover and the other surface of the piezoelectric disk, said spring means being in electrical contact with the electric output terminal, the radial arrangement of said ridges permitting radial outflow of excess adhesive to permit the spring means to force the piezoelectric element into contact with said ridges, whereby good internal electrical ground contact in the first sensing means is assured.

9. Apparatus as defined in claim 8 wherein said liquid is sufficiently viscous to damp noise, wind, sand and debris, while permitting said sensing means to detect impact of a gunfire projectile on the target.

10. Apparatus as defined in claim 1 wherein said first sensing means comprises:

a mounting element for rigid attachment to the member;

a flexing plate supported on the mounting element and adapted to execute plate vibrations in response to impact events on the target, the plate having a surface comprising a plurality of radial grooves with a raised radial ridge on each side thereof;

a piezoelectric disk affixed to the surface of the plate for flexure with vibrations thereof in abutment with the radial ridges by means of an adhesive substance between the raised radial ridges, said ridges providing internal electrical ground contact for one surface of the piezoelectric disk through the plate and mounting element, as well as strain transmission between the plate and the disk;

a cover affixed to the periphery of the plate, the cover including an electrical output terminal; and spring means compressed between the cover and the other surface of the piezoelectric disk, said spring means being in electrical contact with the electric output terminal, the radial arrangement of said ridges permitting radial outflow of excess adhesive to permit the spring means to force the piezoelectric element into contact with said ridges, whereby good internal electrical ground contact in the first sensing means is assured.

11. Apparatus as defined in claim 10 wherein said liquid is sufficiently viscous to damp noise, wind, sand and debris, while permitting said sensing means to detect impact of a gunfire projectile on the target.

12. Apparatus as defined in claim 1 wherein said drive means can rotate said member between a first position with the target raised and said sensing means at least partially concealed, and a second position with the target lowered and said sensing means exposed.

13. Apparatus as defined in claim 1 wherein:

said axis is a longitudinal axis of said member;

said first surface portion is a first longitudinal surface portion of said member; and said second surface portion is a second longitudinal surface portion of said member opposite said first longitudinal surface portion.

14. Apparatus as defined in claim 1 wherein said first and second surface portions are mutually exclusive of each other.

15. Apparatus as defined in claim 14 wherein said first and second surface portions are located on said member opposite each other.

16. Apparatus as defined in claim 14 wherein said first and second surface portions are located on said member antipodal to each other.

17. Apparatus as defined in claim 1 wherein said member is multi-piece.

18. Apparatus as defined in claim 1 wherein:

said member further comprises a second cavity containing said liquid;

said apparatus further comprises second sensing means, connected to said member at said second cavity at said second portion, for sensing any impacts on the target; and said control means is responsive to both said first sensing means and said second sensing means.

19. Apparatus as defined in claim 1 wherein said liquid contacts said first sensing means.

20. Apparatus as defined in claim 1 wherein said driving means comprises:

a rotary driver producing a force; and linkage means for transferring the force from said driver to said member such that said driver can cause said linkage means to rotate said member about its axis.

21. Apparatus as defined in claim 1 wherein said driving means comprises:

a motorized winch;

a wheel coaxially fixed to said member; and a cable including a first end connected to a first location on said winch, a first portion wound in a first rotary direction about a first portion of said winch in a first position of said driving means, a second end connected to a second location on said winch, a second portion wound in a second rotary direction about a second portion of said winch in the first position, and a third portion, located between said first and second cable portions, passing over and connected to said wheel, wherein said first rotary direction is opposite said second rotary direction.

22. Apparatus as defined in claim 21 wherein said driving means further comprises first and second tension arms for tensioning said cable.

* * * * *